US008556633B2

(12) United States Patent
Aaberg

(10) Patent No.: US 8,556,633 B2
(45) Date of Patent: Oct. 15, 2013

(54) DEVICE FOR TEACHING THE USE OF UNDERWATER BREATHING SYSTEMS AND METHOD OF ITS USE

(76) Inventor: Thomas M. Aaberg, Ada, MI (US)

( * ) Notice: Subject to any disclaimer, the term of this patent is extended or adjusted under 35 U.S.C. 154(b) by 640 days.

(21) Appl. No.: 12/756,614

(22) Filed: Apr. 8, 2010

(65) Prior Publication Data

US 2011/0250577 A1 Oct. 13, 2011

(51) Int. Cl.
*A63B 69/10* (2006.01)

(52) U.S. Cl.
USPC ..... 434/254

(58) Field of Classification Search
USPC ..... 434/254
See application file for complete search history.

(56) References Cited

U.S. PATENT DOCUMENTS

| | | | | | |
|---|---|---|---|---|---|
| 2,556,098 | A | * | 6/1951 | Muller | 472/54 |
| 2,593,988 | A | | 4/1952 | Cousteau | |
| 3,064,646 | A | | 11/1962 | Miller | |
| 3,398,878 | A | | 8/1968 | Quiram et al. | |
| 3,467,136 | A | * | 9/1969 | Masson | 137/489 |
| 4,014,384 | A | * | 3/1977 | Marcus | 165/10 |
| 4,030,493 | A | * | 6/1977 | Walters et al. | 128/206.21 |
| 4,189,791 | A | * | 2/1980 | Dundas | 126/564 |
| 4,398,533 | A | * | 8/1983 | Barker | 128/202.15 |
| 4,640,277 | A | * | 2/1987 | Meyer et al. | 128/204.23 |
| 4,674,493 | A | | 6/1987 | Mitchell | |
| 4,796,618 | A | * | 1/1989 | Garraffa | 128/204.26 |
| 4,821,712 | A | * | 4/1989 | Gossett | 128/205.15 |
| 4,832,013 | A | | 5/1989 | Hartdorn | |
| 4,919,631 | A | | 4/1990 | Stafford | |
| 4,986,267 | A | | 1/1991 | Doss | |
| 5,092,327 | A | | 3/1992 | Tragatschnig | |
| 5,143,060 | A | * | 9/1992 | Smith | 128/205.28 |
| 5,193,530 | A | | 3/1993 | Gamow et al. | |
| 5,199,425 | A | * | 4/1993 | Perrier | 128/204.26 |
| 5,297,545 | A | | 3/1994 | Infante | |
| 5,327,849 | A | | 7/1994 | Miller | |
| 5,351,681 | A | | 10/1994 | Hudson | |
| 5,471,976 | A | | 12/1995 | Smith | |
| 5,535,734 | A | | 7/1996 | Lu et al. | |
| 5,606,967 | A | | 3/1997 | Wang | |
| 5,813,952 | A | * | 9/1998 | Lochbaum | 482/111 |
| 5,906,200 | A | | 5/1999 | Kaburaki | |
| 5,924,416 | A | | 7/1999 | Miller | |
| 5,947,116 | A | | 9/1999 | Gamow et al. | |
| 6,293,733 | B1 | | 9/2001 | Tezuka | |
| 6,401,711 | B1 | | 6/2002 | Tibbs et al. | |
| 6,478,024 | B1 | | 11/2002 | White, Jr. | |
| 7,011,089 | B2 | | 3/2006 | Tokatlian | |
| 7,159,528 | B1 | | 1/2007 | Hilliker | |
| 7,353,767 | B2 | | 4/2008 | Taelman | |

(Continued)

*Primary Examiner* — Kurt Fernstrom
*Assistant Examiner* — Dolores Collins
(74) *Attorney, Agent, or Firm* — Price Heneveld LLP

(57) ABSTRACT

A method for teaching an adult or child how to breathe through an air regulator is provided. The method includes providing an air regulator and a first air pump positioned at a location proximate a residential pool and outside of the residential pool, wherein the air regulator and the air pump are operatively connected with one another via a hose that allows air to flow from the air pump and be supplied to the air regulator in an amount sufficient for a human child or adult that is able to swim to breathe. The method further includes supplying the adult or child air from the air pump via the hose and through the air regulator to allow the adult or child to breathe underwater in the residential pool.

19 Claims, 5 Drawing Sheets

(56) References Cited

U.S. PATENT DOCUMENTS

| | | | | |
|---|---|---|---|---|
| 7,394,387 | B2 * | 7/2008 | Noonchester | 340/573.1 |
| 2002/0117172 | A1 | 8/2002 | Chiang | |
| 2002/0166555 | A1 | 11/2002 | Antonelli | |
| 2005/0000516 | A1 | 1/2005 | Saillet et al. | |
| 2007/0076527 | A1 * | 4/2007 | Romano | 367/134 |
| 2009/0118646 | A1 * | 5/2009 | Svanberg et al. | 600/587 |

* cited by examiner

DEVICE FOR TEACHING THE USE OF UNDERWATER BREATHING SYSTEMS AND METHOD OF ITS USE

SUMMARY OF THE INVENTION

The present invention generally relates to an underwater breathing system for use in manmade bodies of water. The present invention also generally relates to a method of teaching individuals, including children, how to engage in underwater activities, as well as how to become comfortable with breathing through an assistance system regulator, in a calm environment such as a manmade body of water. The present invention also relates to a method of overcoming a fear of swimming and/or water.

One specific aspect of the learning period includes establishing a feeling of comfort while breathing through an assistance system while submerged underwater.

According to one aspect of the present invention, a method for teaching an adult or child how to breathe through an air regulator is provided. The method includes providing an air regulator and a first air pump positioned at a location proximate a residential pool, typically at about the water's edge, and outside of the residential pool, wherein the air regulator and the air pump are operatively connected with one another via a hose that allows air to flow from the air pump and be supplied to the air regulator in an amount sufficient for a human child or adult, which is capable of swimming, to breathe. The method further includes supplying the adult or child air from the air pump via the hose and through the air regulator to allow the adult or child to breathe underwater in the residential pool.

According to another aspect of the present invention, a method is provided for establishing a feeling of comfort in an individual while breathing underwater through a pressure regulating device. The method includes providing an air supply device located outside a manmade swimming pool and proximate the perimeter of the manmade swimming pool. The method further includes connecting a hose to the pressure regulating device, wherein the hose includes a mouthpiece, initiating the air supply device causing the air supply device to move air through the hose and supply air to the individual via the mouthpiece. The method also includes inserting the mouthpiece into a user's mouth, submerging the user's mouth into in a manmade body of water, regulating the pressure of the air supplied to the individual and supplying the air at a pressure suitable for breathing by a human at various water depths, and the individual breathing as needed while the user's mouth and nose are underwater, and wherein the individual does not have a source of air underwater for the individual's use for breathing while in the manmade swimming pool.

According to yet another embodiment of the present invention, a method for learning how to engage in underwater activities is provided. The method includes providing an air pump that is connected to a flexible air supply hose, generating a flow of breathable air to a user that is at least partially submerged in a residential pool, connecting a mouthpiece to one end of the flexible air supply hose, initiating the air pump, and inserting the mouthpiece into the user's mouth to breathe air while engaging in an underwater activity.

These and other features, advantages, and objects of the present invention will be further understood and appreciated by those skilled in the art by reference to the following specification, claims, and appended drawings.

DETAILED DESCRIPTION

Figure 1:
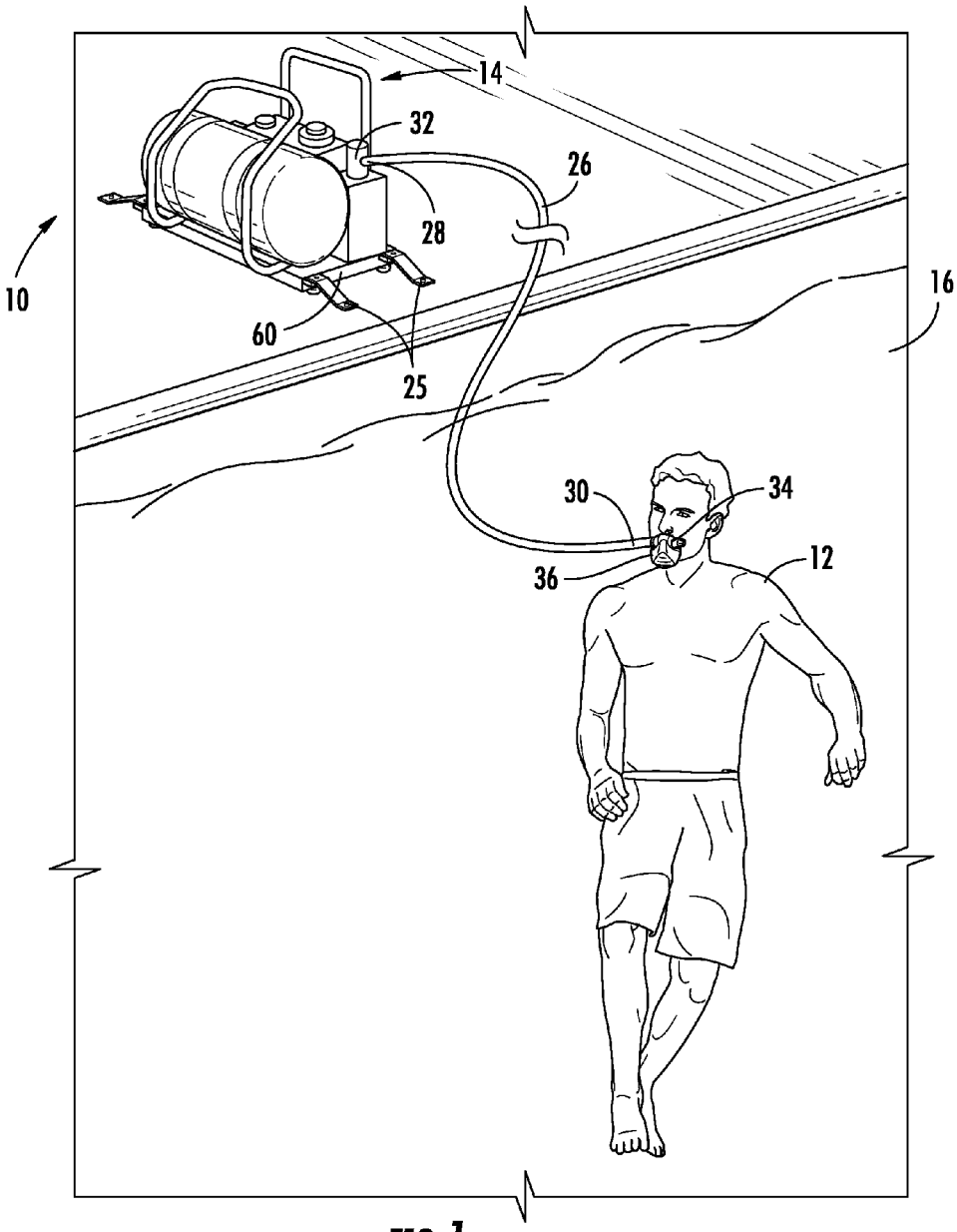
FIG. 1 is a perspective view of an individual breathing underwater in a manmade body of water via an air supply device that is mounted on a stable platform.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a system for supplying air to an individual 12 in a manmade body of water. An embodiment of the present invention is generally directed toward a method of using the system for the purpose of teaching individuals how to engage in various underwater activities as well as a method to allow a swimmer, typically a child, to feel comfortable underwater. One significant obstacle in teaching individuals how to engage in underwater activities is the initial breathing uneasiness one may feel, a feeling often felt by children and first-time swimmers as well as those using a regulator for the first time. This uneasiness is compounded when the teaching is conducted in a large body of natural water, such as an ocean. The present system allows an individual to establish a feeling of comfort while breathing underwater through a pressure regulating device, where the teaching is conducted in a calm manmade body of water, most typically a residential or community pool. The residential or community pool is typically a manmade pool that does not have any water flow forces applied to it except for filling forces. The residential or commercial pools most typically used in connection with the present invention are not wave pools or other similar pools with mechanical and other devices for creating artificial waves.

Figure 2:
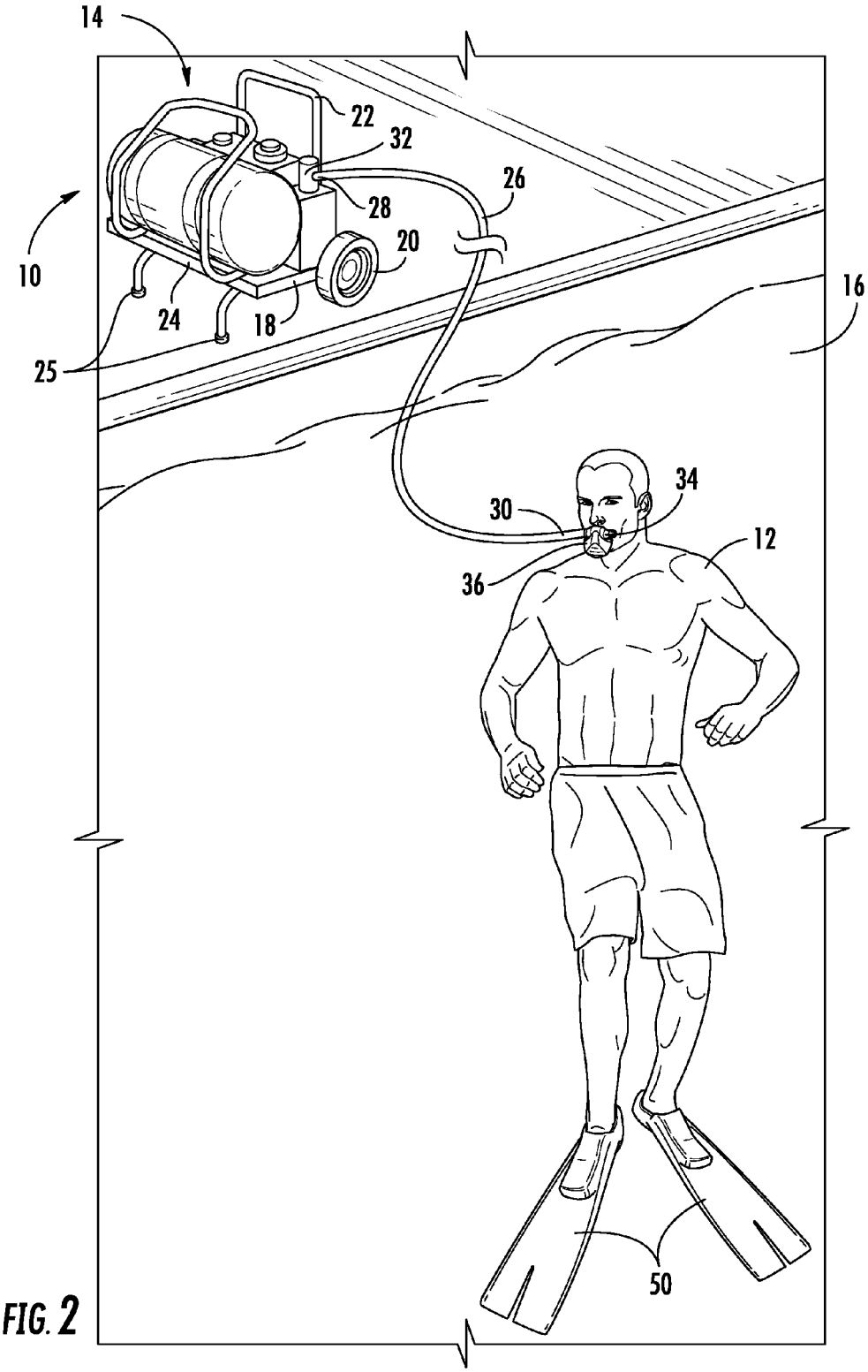
FIG. 2 is a perspective view of an individual breathing underwater in a manmade body of water via an air supply device that is mounted on a movable cart.

The system typically includes an air supply device 14, such as an air pump, that is located outside of the pool 16, but typically very close to the edge of the water, typically within about 5-10 feet. As an alternative to simply placing the air supply device 14 on the ground or on a stationary platform 60, the air supply device 14 may be conveniently placed on a movable cart 18, thereby allowing relative portability of the air supply device 14 (FIG. 2). Such a movable cart 18 may be in the form of a wheeled dolly cart that includes at least two wheels 20 and a handle portion 22 that extends upward from the base 24. The air supply device 14 itself is typically releasably securely anchored to either the cart 18 or directly to the outside of the water perimeter area surrounding the pool 16. If affixed to a moveable cart 18 the moveable cart 18 is typically releaseably securely anchored to the outside water perimeter area surrounding the swimming pool 16. The anchoring systems 25 are typically quick release, anchor systems 25 that require enough force to be applied to the opening mechanism such that the anchoring system 25 cannot be released by a child less than about 14 years old. In one embodiment the anchor system 25 employs a key locking system. In yet another embodiment the anchor system 25 employs a locking mechanism with a numeric code required to making the anchor system 25 capable of opening. Preferably at least two anchoring systems 25 anchor the air supply device 14 to a surface outside of the water in the pool 16. This provides added safety by preventing the air supply device(s) 14 from accidentally being pushed into the water within the pool 16. The anchoring systems 25 may have an outside water perimeter area anchor peg securely driven into the ground or cement of the perimeter area or integrally constructed into the ground at the time the residential pool 16 is constructed to ensure that it is not removable.

Further, the anchor peg would optionally have a biased end, typically a spring biased end that would allow one end of the anchor peg to move between an elevated, upward position, and a retracted, downward position. When in the downward position, the anchor peg may be positioned within a cavity shell that optionally may be covered with a retractable covering portion, typically a plastic lid that can roll up like a typical garage door having connected segments, following a track on the opposing sides of the cavity shell. The cavity shell may be plastic or metal. The cavity shell may also have an aperture in the bottom that allows the anchor peg to pass through it. As a further alternative, the air supply device 14 may be secured atop a floatable structure, such as a raft.

Extending from the air supply device 14 is at least one hose 26 that runs from a first end 28 to a user 12 in the pool 16 at a second end 30 of the hose 26. The hose 26 may be made of a flexible elastomeric material, where the material may include, but is not limited to, a saturated rubber, an unsaturated rubber, a thermoplastic elastomer, or combinations thereof. Located proximate the first end 28 of the hose 26 may be a first air regulator 32 that reduces the air pressure in the air supply device 14, which is typically at least 200 psi, and even more typically may be between 2000 psi and 3000 psi, depending on the type of air supply device 14 employed. The first air regulator 32 reduces the air supply device 14 air pressure to a lower range prior to entering the hose 26, typically, but not limited to, 50 psi to 150 psi. Located at the second end 30 of the hose 26 is a mouthpiece 34 that may be configured to simply insert into the user's mouth or alternatively may include a more complicated mask, thereby allowing the user to breathe as needed. A second air regulator 36 is typically positioned proximate the second end 30 of the hose 26, in order to effectively further reduce the air pressure to a suitable breathable level for the user, which varies depending on the water depth of the user. Both the first and second air regulators 32, 36 may include one or a series of valves 38 to assist in the functioning of reducing air pressure, as well as ensuring that air is only delivered upon demand from the user.

The method of using the system includes providing the aforementioned system 10 at a location proximate the pool 16 and assembling the system in a manner consistent with the above description. The assembly step includes, but is not limited to, connecting the hose 26 to the air supply device 14 and initiating the air supply device 14, such that pressure regulated air is supplied to the hose 26. Prior to entering the pool 16, the user inserts the mouthpiece 34 into the user's mouth and/or placing the mask over the user's mouth. Once the mouthpiece 34 or mask is secure, the user submerges at least his/her mouth in the manmade body of water 16. Because of the flexible nature of the hose 26, the user is then free to engage in various underwater activities, while establishing a feeling of comfort breathing through an assistance system that regulates the pressure and availability of breathable air. This also allows the user to become familiar with breathing through the air regulator in the relatively significantly safer environment of a swimming pool instead of a large, natural body of water such as a lake or ocean, which has an entire ecosystem and uncontrolled water waves and water flow. This greatly assists the safety and learning speed when initially learning to use the regulator.

Figure 3:
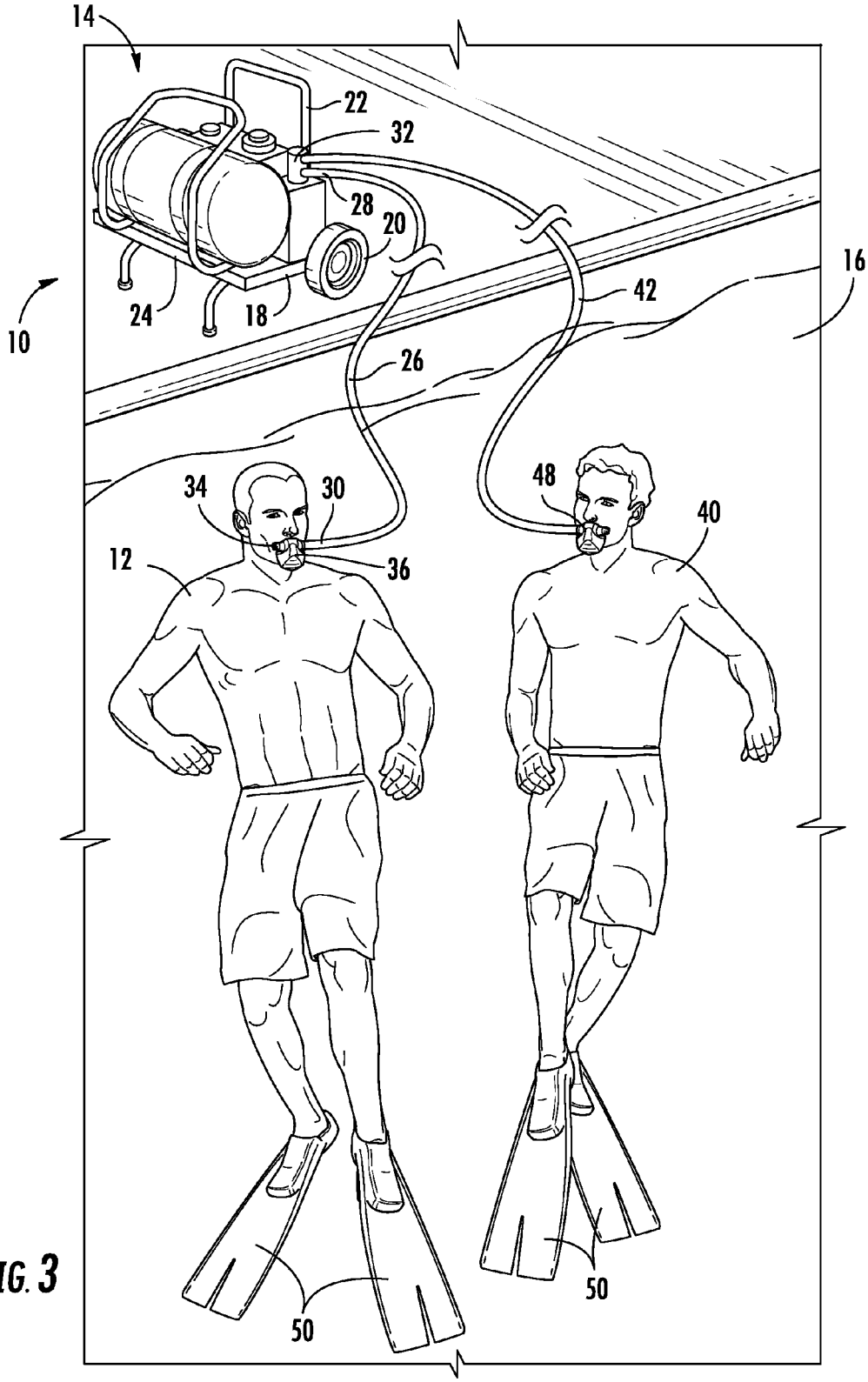
FIG. 3 is a perspective view of two individuals breathing underwater in a manmade body of water via a plurality of hoses from a single air supply device.
Figure 4:
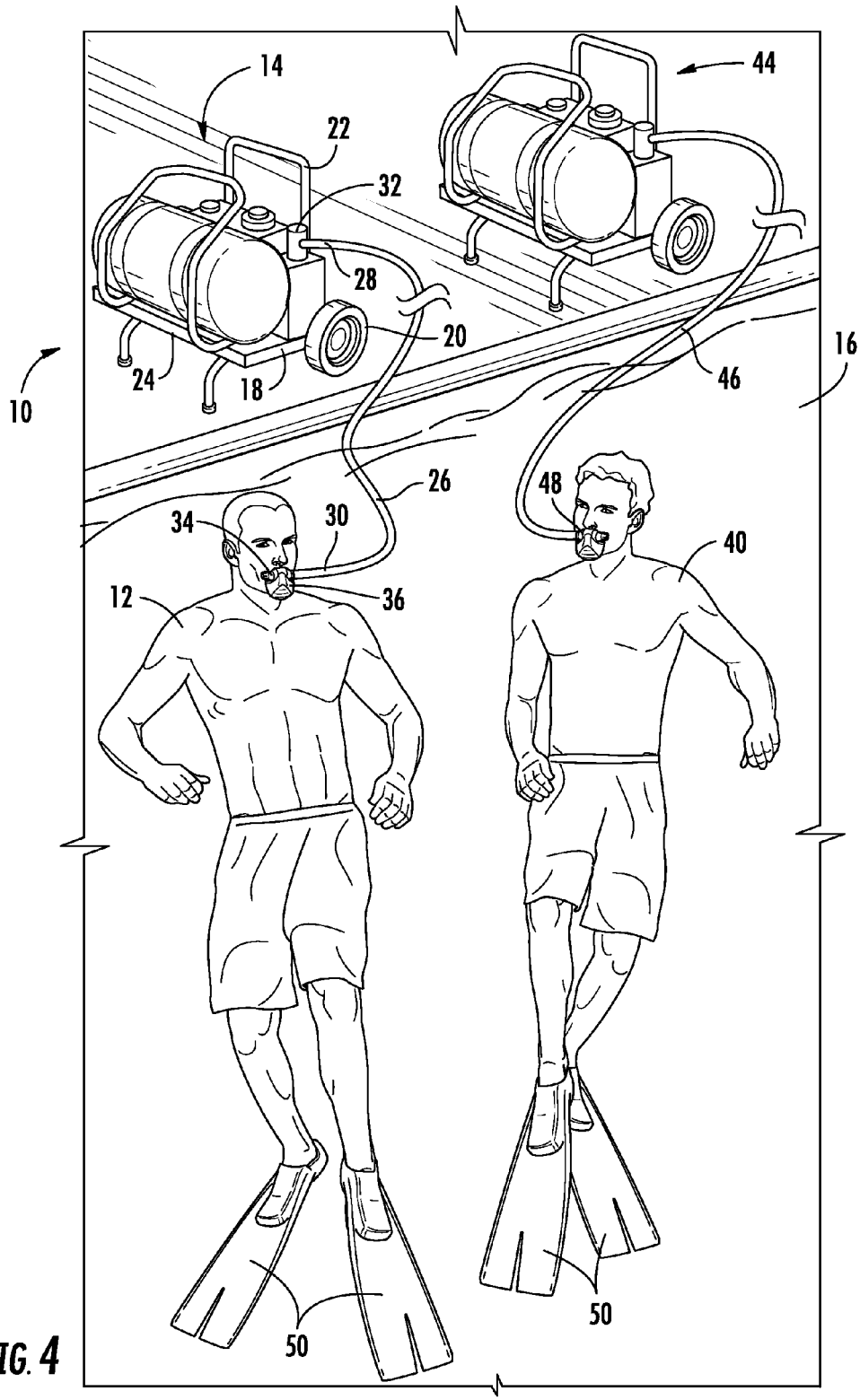
FIG. 4 is a perspective view of two individuals breathing underwater in a manmade body of water via a plurality of air supply devices.
Figure 5:
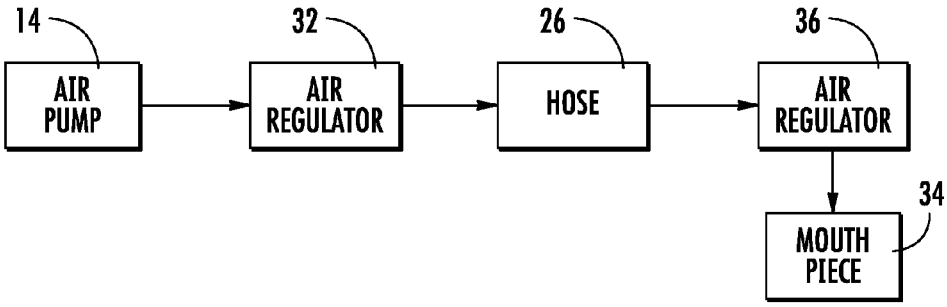
FIG. 5 is a schematic view of a method of supplying air to an individual submerged in a manmade body of water.

The method provides a single user 12 to engage in underwater activities independently, as described above, but also provides for a second individual 40, such as an instructor, to join the first user 12 in the pool 16 (FIG. 3). A plurality of users may each have individual subsystems of the systems described above or systems individually. The second user or any subsequent user 40 may be supplied air in one of two manners. First, the air supply device 14 may include a second connectable hose 42 that is available for the second user 40 to breathe through. The second hose 42 is configured similar to the first hose 26 and is associated with similar air pressure regulators. As another embodiment, the second user 40 may be supplied air via a second air supply device 44 that is substantially identical or identical in structure as that of the first air supply device 14 (FIG. 4). The second air supply device 44 is associated with a hose 46, air regulator(s), as well as a mouthpiece 48 and/or mask, as described above in relation to the first user's system 10. Both embodiments may be provided for more than two users, if needed. As discussed briefly above, such a case would include a plurality of hoses from a single air supply device or a plurality of air supply devices for multiple users.

Irrespective of the embodiment employed, the second user 40 may teach the first user 12 how to engage in various underwater activities, and/or at least initially, be there to provide an even further level of comfort of being in the water to the first user. Such activities may include, but is not limited to, swimming, scuba diving, and snorkeling. Additionally, the second user 40 may provide the first user 12 with assistance in establishing a feeling of breathing comfort by aiding in any required adjustments to the mouthpiece 34 and/or mask. This is particularly relevant when the first user 12 is a child that may be uncomfortable with breathing through such a system 10 and/or wearing equipment associated with activities like scuba diving or snorkeling. Equipment such as fins 50 and a face mask may initially feel cumbersome and the instructor 40 is present to assist in establishing a feeling of comfort. In addition, the present invention is directed toward use in manmade bodies of water, which are calm in nature, thereby providing a more conducive environment for learning to engage in the above described activities.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A method for establishing a feeling of comfort for being in water in an individual that is afraid to swim or be in water that is deeper than a height the individual can stand in, and for breathing underwater through a pressure regulating device, comprising:

providing an air supply device located outside a manmade swimming pool and proximate a perimeter of the manmade swimming pool, the air supply device having the pressure regulating device operatively connected thereto;

connecting a hose to the pressure regulating device, wherein the hose includes a mouthpiece;

initiating the air supply device causing the air supply device to move air through the hose and supply air to the individual via the mouthpiece;

inserting the mouthpiece into a user's mouth;

submerging the user's mouth into a manmade body of water;

regulating the pressure of the air supplied to the individual and supplying the air at a pressure suitable for breathing by a human at various water depths;

teaching the individual about how to wear the mouthpiece; and the individual breathing as needed while the user's mouth and nose are underwater, and wherein the individual does not have a source of air underwater for the individual's use for breathing while in the manmade swimming pool.

2. The method of claim 1 further comprising the step of teaching the individual to swim in the manmade pool while breathing through the mouthpiece when the individual's nose and mouth are underwater and wherein pressure regulating device is a first pressure regulating device that is connected to the hose proximate a first end of the hose and the method further comprises connecting a second pressure regulating device to a second end of the hose.

3. The method of claim 1, wherein the pressure regulating device is a first pressure regulating device that is connected to the hose proximate a first end of the hose and the method further comprises connecting a second pressure regulating device to a second end of the hose and wherein the first pressure regulating device reduces the air pressure prior to entering the hose and the second pressure regulating device is positioned proximate the second end of the hose and the mouthpiece and wherein the method further comprises the step of teaching the individual to snorkel in the manmade pool while breathing through the mouthpiece when the individual's nose and mouth are underwater.

4. The method of claim 1 further comprising the steps of teaching the individual to scuba dive in the manmade pool while breathing through the mouthpiece when the individual's nose and mouth are underwater and releaseably engaging the air supply device to an anchor peg fixedly engaged to the perimeter of the manmade swimming pool.

5. The method of claim 1, wherein the air supply device is an air pump capable of being moved between a plurality of locations proximate the manmade swimming pool and comprising at least two wheels.

6. The method of claim 1, wherein the air supply device further comprises a check valve to assist in regulating the air pressure delivered to the individual.

7. The method of claim 1, wherein the hose is a flexible elastomeric material and wherein a plurality of hoses, pressure regulating devices and mouthpieces are provided where each hose is generally connected with the air supply device and the pressure regulating device is operably connected to the mouthpiece.

8. A method for preventing a fear of swimming in a child while the child is learning how to engage in scuba diving, snorkeling, or swimming, comprising:

providing an air pump that is connected to a flexible air supply hose, a first pressure regulating device, and a second pressure regulating device;

connecting the first pressure regulating device to the hose proximate a first end of the hose;

connecting the second pressure regulating device to a second end of the hose;

generating a flow of breathable air to the child while the child is at least partially submerged in a residential pool;

connecting a mouthpiece to one end of the flexible air supply hose;

activating the air pump to start air flow through the flexible air supply hose;

inserting the mouthpiece into the child's mouth to breathe the air supplied by the air pump while engaging in an underwater activity;

instructing the child how to breathe air supplied by the air pump; and wherein the first pressure regulating device reduces the air pressure supplied from the air pump prior to entering the hose from the air pump and the second pressure regulating device is positioned proximate the second end of the hose and the mouthpiece and further reduces the air pressure of air in the hose supplied by the pump such that air breathed by the child is at a breathing air pressure level.

9. The method of claim 8, wherein the air pump further comprises a check valve to assist in regulating the air pressure delivered to the child.

10. The method of claim 9, wherein the air pump further comprises a check valve to assist in regulating the air pressure delivered to the child.

11. The method of claim 9 further comprising the step of providing a teacher who is also underwater with the child, wherein the teacher breathes underwater using a second air regulator operably connected to either the air pump or a second air pump positioned at a location proximate the residential pool.

12. The method of claim 10, wherein the air pump is capable of being moved between a plurality of locations proximate the residential pool and comprises at least two wheels.

13. The method of claim 12 further comprising the step of providing a teacher who is also underwater with the child, wherein the teacher breathes underwater using a second air regulator operably connected to either the air pump or a second air pump positioned at a location proximate the residential pool.

14. The method of claim 13, wherein the hose is a flexible elastomeric material and wherein a plurality of hoses, pressure regulating devices and mouthpieces are provided where each hose is generally connected with the air pump and the pressure regulating device is operably connected to the mouthpiece.

15. The method of claim 10 further comprising the step of providing a teacher who is also underwater with the child, wherein the teacher breathes underwater using a second air regulator operably connected to either the air pump or a second air pump positioned at a location proximate the residential pool.

16. The method of claim 8, wherein the step of supplying air further comprises passing air through an air regulator for adjusting the air pressure to suitable levels at various water depths.

17. The method of claim 8, wherein the air pump is capable of being moved between a plurality of locations proximate the residential pool and comprises at least two wheels.

18. The method of claim 8, wherein the hose is a flexible elastomeric material and wherein a plurality of hoses, pressure regulating devices and mouthpieces are provided where each hose is generally connected with the air pump and the pressure regulating device is operably connected to the mouthpiece.

19. The method of claim 8 further comprising the step of providing a teacher who is also underwater with the child, wherein the teacher breathes underwater using a second air regulator operably connected to either the air pump or a second air pump positioned at a location proximate the residential pool.

* * * * *